US008208841B2

(12) United States Patent
Uehashi

(10) Patent No.: US 8,208,841 B2
(45) Date of Patent: Jun. 26, 2012

(54) DEVELOPING DEVICE AND IMAGE FORMING APPARATUS

(75) Inventor: Tetsuya Uehashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 247 days.

(21) Appl. No.: 12/801,199

(22) Filed: May 27, 2010

(65) Prior Publication Data

US 2010/0329749 A1 Dec. 30, 2010

(30) Foreign Application Priority Data

Jun. 26, 2009 (JP) ..... 2009-152357

(51) Int. Cl.
*G03G 15/00* (2006.01)

(52) U.S. Cl. ..... 399/288; 399/162; 399/239; 399/278

(58) Field of Classification Search ..... 399/162, 399/239, 278, 288
See application file for complete search history.

(56) References Cited

U.S. PATENT DOCUMENTS 3,147,679 A * 9/1964 Schaffert ..... 430/48
5,987,282 A * 11/1999 Tsukamoto et al. ..... 399/237
5,999,779 A * 12/1999 Takeuchi ..... 399/239
6,029,036 A * 2/2000 Itaya et al. ..... 399/239
6,137,976 A * 10/2000 Itaya et al. ..... 399/233
7,676,181 B2 * 3/2010 Ueda et al. ..... 399/239
2008/0253811 A1 * 10/2008 Minegishi et al. ..... 399/272
2009/0202278 A1 * 8/2009 Ito ..... 399/288

FOREIGN PATENT DOCUMENTS

JP 07-064445 A 3/1995
JP 2007-316532 A 12/2007
JP 2008-268254 A 11/2008
JP 2009-003213 A 1/2009
JP 2009-133982 A 6/2009

* cited by examiner

*Primary Examiner* — David Gray
*Assistant Examiner* — Francis Gray
(74) *Attorney, Agent, or Firm* — Rabin & Berdo, P.C.

(57) ABSTRACT

A developing device develops an electrostatic latent image on an image bearing body, and includes first, second and third rollers, a developing belt and a developer supply member. The developing belt, which is entrained about the first, second and third rollers, is opposed to the image bearing body between the first and second rollers, and is in contact with the developer supply member between the first and third rollers. The developer supply member supplies a developer to the developing belt.

19 Claims, 4 Drawing Sheets

DEVELOPING DEVICE AND IMAGE FORMING APPARATUS

CROSS-REFERENCE TO RELATED APPLICATION

This application claims priority based on 35 USC 119 from prior Japanese Patent Application No. P 2009-152357 filed on Jun. 26, 2009, the entire contents of which are incorporated herein by reference.

BACKGROUND OF THE INVENTION

1. Field of the Invention

This application relates to a developing device and an image forming apparatus including the developing device.

2. Description of the Related Art

An image forming apparatus employing electrophotographic technology, such as a printer, a copier, a facsimile machine or a multifunction peripheral (MFP), performs processes of charging, exposing, developing, transferring, cleaning and neutralizing on a photosensitive drum or in the vicinity thereof. A toner image formed on the photosensitive drum is transferred to and fixed on a sheet as a medium.

A printer that incorporates a belt-type developing device, which includes a developing belt and a developing roller, is well known. The developing belt provides an electrostatic latent image formed on a photosensitive drum with toner to form a toner image thereon. The developing roller supplies the developing belt with the toner and scrapes residual toner, which does not contribute to forming the toner image, off the developing belt. A voltage for supplying the developing belt with the toner is applied to the developing roller. Japanese Patent Laid-Open No. 07-134646 discloses one such developing device.

In the aforementioned belt-type developing device, however, the residual toner cannot be fully removed from the developing belt, thereby forming a residual image caused by the residual toner on a sheet. This will cause adverse effects on print quality.

SUMMARY OF THE INVENTION

An object of the application is to disclose a developing device and an image forming apparatus capable of preventing a residual image from being formed on a medium and of improving print quality.

In one aspect, a developing device develops an electrostatic latent image on an image bearing body, and includes first, second and third rollers, a developing belt and a developer supply member. The developing belt, which is entrained about the first, second and third rollers, is opposed to the image bearing body between the first and second rollers, and is in contact with the developer supply member between the first and third rollers. The developer supply member supplies a developer to the developing belt.

In another aspect, an image forming apparatus includes a medium storage unit, a developing unit, a transfer unit and a fixing unit. The medium storage unit accommodates a medium. The developing unit develops an electrostatic latent image on an image bearing body to form a developed image, and includes first, second and third rollers, a developing belt and a developer supply member. The developing belt, which is entrained about the first, second and third rollers, is opposed to the image bearing body between the first and second rollers, and is in contact with the developer supply member between the first and third rollers. The developer supply member supplies a developer to the developing belt. The transfer unit transfers the developed image to the medium and the fixing unit fixes the developed image on the medium.

The full scope of applicability of the developing device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The developing device and the image forming apparatus will become more fully understood from the detailed description given herein and the accompanying drawings, which are given by way of illustration only, and thus do not limit the invention, and wherein.

DETAILED DESCRIPTION OF THE INVENTION

Preferred embodiments of a developing device and an image forming apparatus according to the invention will be described in detail with reference to the accompanying drawings. In each embodiment, the description will be given with a color printer as an image forming apparatus.

First Embodiment

Figure 1:
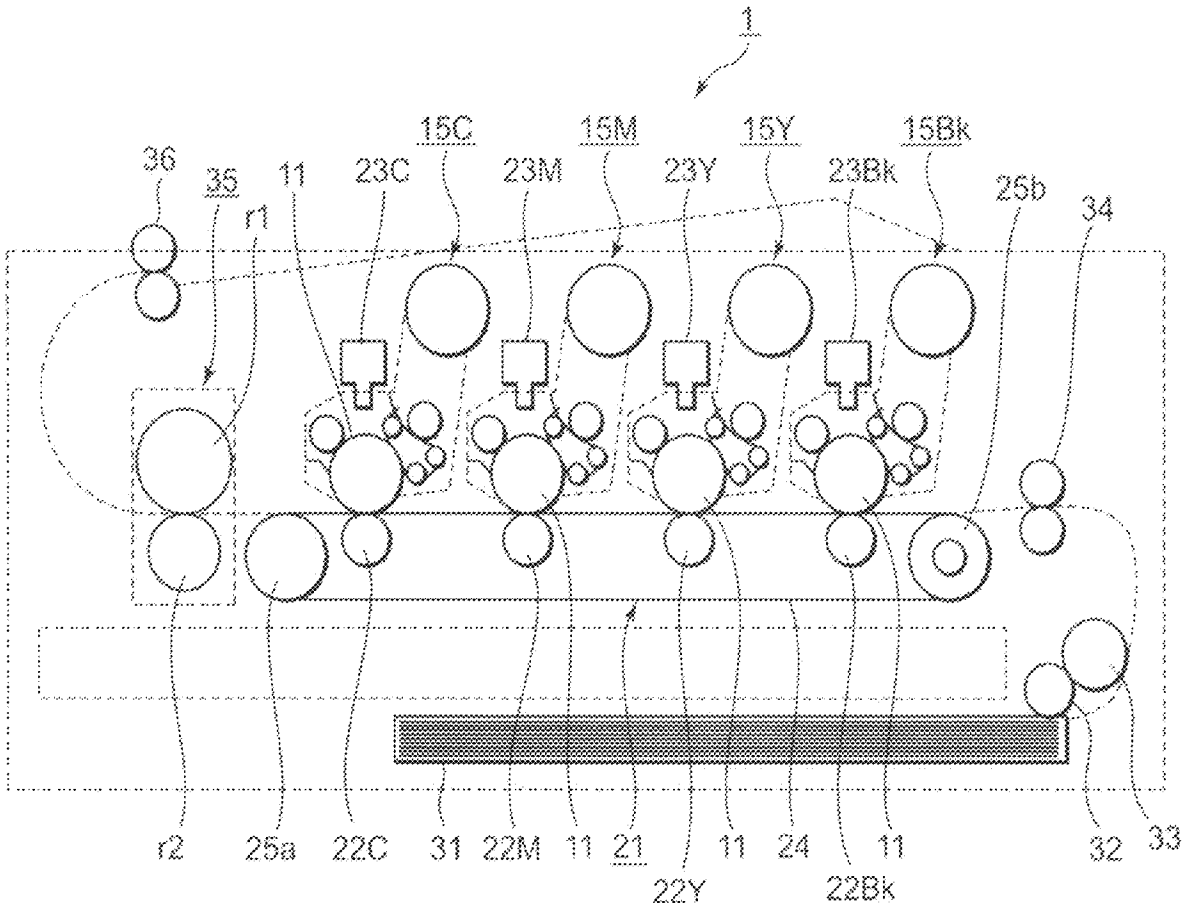
FIG. 1 is a schematic view of a printer of a first embodiment.

FIG. 1 is a schematic view of a printer 1 according to a first embodiment, which may include image-forming units 15Bk, 15Y, 15M and 15C, LED (Light-Emitting Diode) heads 23Bk, 23Y, 23M and 23C, a transfer unit 21, a sheet cassette 31, a hopping roller 32, a transport roller 33, transport rollers 34, a fixing unit 35 and discharge rollers 36.

The image-forming units 15Bk, 15Y, 15M and 15C respectively form a black toner image, a yellow toner image, a magenta toner image and a cyan toner image. The LED heads 23Bk, 23Y, 23M and 23C are respectively disposed corresponding to the image-forming units 15Bk, 15Y, 15M and 15C. Each of the LED heads 23Bk, 23Y, 23M and 23C employs LED elements as light sources and forms an electrostatic latent image on a surface of each of photosensitive drums 11 of the image-forming units 15Bk, 15Y, 15M and 15C. The LED heads 23BK, 23Y, 23M and 23C may be replaced with laser heads.

The transfer unit 21, which is disposed under the image-forming units 15Bk, 15Y, 15M and 15C, may include transfer rollers 22Bk, 22Y, 22M and 22C, a transfer belt 24, a drive roller 25*a* and an idle roller 25*b*. The transfer belt 24 is rotatably entrained about the drive roller 25*a* and the idle roller 25*b*. The transfer rollers 22Bk, 22Y, 22M and 22C are respectively opposed to the photosensitive drums 11 of the image-forming units 15Bk, 15Y, 15M and 15C through the transfer belt 24. The transfer rollers 22Bk, 22Y, 22M and 22C sequentially superimpose and transfer the toner images formed on the photosensitive drums 11 onto a sheet conveyed by the transfer belt 24, thereby forming a color toner image on the sheet.

The sheet cassette 31 as a medium storage unit is disposed below the transfer unit 21 and accommodates a stack of sheets therein. The hopping roller 32, which is provided in the vicinity of the front end of the sheet cassette 31, picks up the sheet one-by-one from the sheet cassette 31 and feeds the sheet to the transport roller 33. The transport roller 33 and the transport rollers 34 transfer the sheet fed by the hopping roller 32 toward the image-forming units 15Bk, 15Y, 15M and 15C.

The fixing unit 35 as a fixing device, which is disposed downstream of the image-forming units 15Bk, 15Y, 15M and 15C in the sheet transport direction, may include a fixing roller r1, serving as a heat roller, and a pressure roller r2. The fixing unit 35 fixes the color toner image transferred to the sheet by the transfer unit 21 onto the sheet, thereby forming a color image thereon. The discharge rollers 36 discharge the sheet with the color image thereon from the printer 1.

Next, the image-forming units 15Bk, 15Y, 15M and 15C will be described. Because the image-forming units 15Bk, 15Y, 15M and 15C have the same structures, except for toner colors, the image-forming unit 15Bk, forming a black image, will be described by way of example here.

Figure 2:
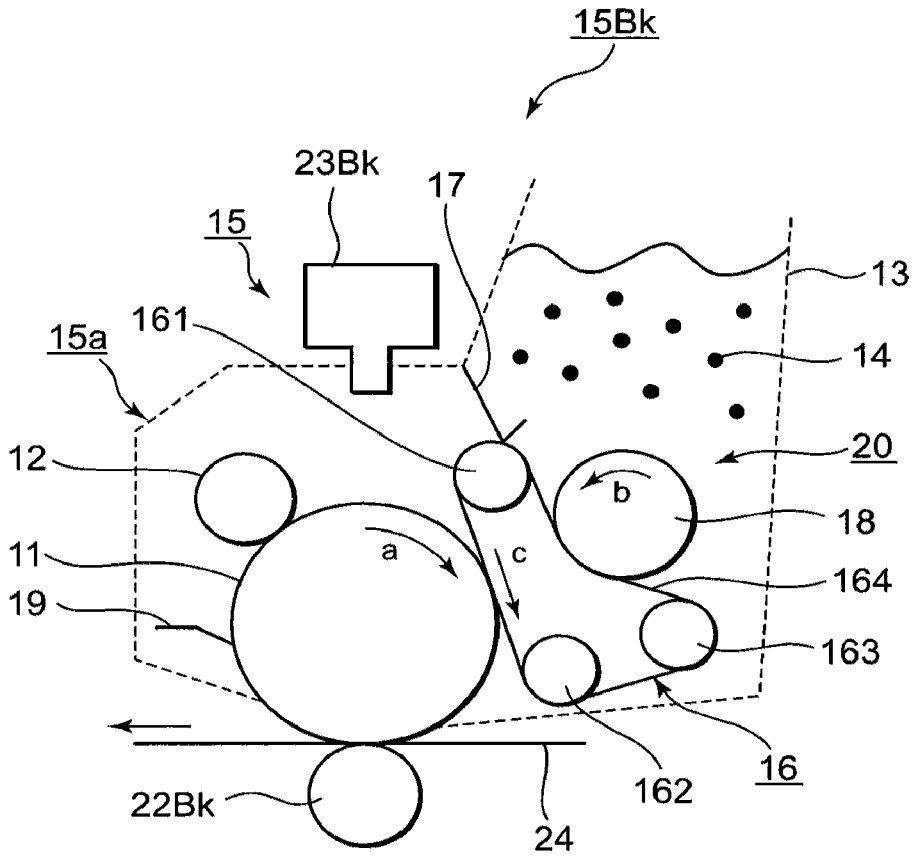
FIG. 2 is a schematic view of an image-forming unit of the first embodiment.

FIG. 2 is a schematic view of the image-forming unit 15Bk, which may include a main body 15*a* and a toner cartridge 13 detachably mounted to the main body 15*a*. The toner cartridge 13 as a developer storage unit stores toner 14 therein.

The main body 15*a* may include the photosensitive drum 11, a charging roller 12, a cleaning blade 19 and a developing unit 20. The photosensitive drum 11 as an image bearing body is cylindrical and bears an electrostatic latent image as a latent image on a surface thereof. The photosensitive drum 11 has a photoreceptor made of an organic optical semiconductor on the surface, and rotates in a direction shown by an arrow "a" in FIG. 2.

The charging roller 12 as a charging member is in contact with the surface of the photosensitive drum 11, and applies an electric charge to the photoreceptor of the photosensitive drum 11, thereby uniformly charging the surface of the drum 11 at about −600 V. Therefore, the charging roller 12 receives a negative voltage from a power supply, not shown. The LED head 23Bk exposes the surface of the photosensitive drum 11, charged at about −600 V by the charging roller 12, to form the electrostatic latent image thereon. The electric potential of a surface portion of the photosensitive drum 11 where the electrostatic latent image is formed, may become about −50 V. The charging roller 12 is rotated by the photosensitive drum 11 so as to prevent the photosensitive drum 11 from wearing by the friction between the photosensitive drum 11 and the charging roller 12.

The cleaning blade 19 as a cleaning member scrapes residual toner, which has remained on the photosensitive drum 11 after a transfer process, off the surface of the photosensitive drum 11. The developing unit 20 as a developing device develops the electrostatic latent image formed on the surface of the photosensitive drum 11, with the toner 14, and forms a toner image as a developed image on the photosensitive drum 11.

Next, the developing unit 20 will be described in detail with reference to FIG. 3.

Figure 3:
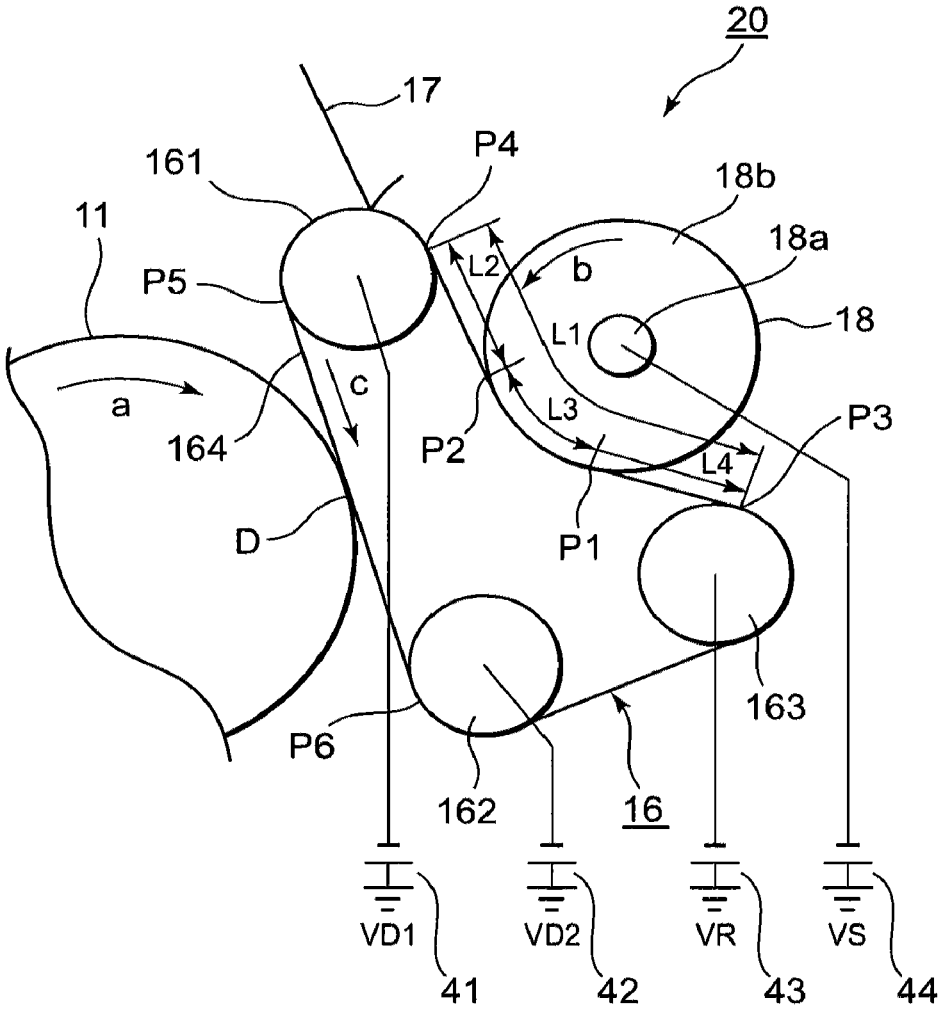
FIG. 3 is a schematic view of a developing unit of the first embodiment.

FIG. 3 is a schematic view of the developing unit 20, which includes a developing belt unit 16, a toner supply roller 18 and a developing blade 17. The developing belt unit 16 includes a first roller 161, a second roller 162, a third roller 163 and a developing belt 164. Each of the rollers 161, 162 and 163 is made of a conductive material, such as a metal. The developing belt 164 is entrained about the rollers 161, 162 and 163.

The toner supply roller 18 as a developer supply member is provided between the first roller 161 and the third roller 163 so as to contact the developing belt 164 at a predetermined pressure. The toner supply roller 18 supplies the developing belt 164 with the toner 14 while rotating in a direction shown by an arrow "b" in FIG. 3. The developing blade 17 is opposed to the first roller 161 through the developing belt 164 and is in contact with the developing belt 164 to form a thin layer of the toner 14 thereon.

The developing belt 164 is opposed to the photosensitive drum 11 between the first roller 161 and the second roller 162, and supplies the photosensitive drum 11 with the toner 14 on the developing belt 164. In the first embodiment, the developing belt 164 is in contact with the photosensitive drum 11. However, the developing belt 164 may be provided without making contact with the photosensitive drum 11.

The first roller 161 serves as a drive roller. The first roller 161 is driven by a drive motor, not shown, and rotates the developing belt 164 in a direction shown by an arrow "c" in FIG. 3. The second roller 162 and the third roller 163 serve as driven rollers. The rollers 162 and 163 are rotated by the movement of the developing belt 164. Therefore, at least one of the rollers 162 and 163 is urged in a direction away from the first roller 161 by a coil spring or the like as a pressure member, not shown, thereby providing the developing belt 164 with predetermined tension. Note that the developing belt 164 rotates in the reverse direction of the rotational direction of the photosensitive drum 11 and in the same direction as the rotational direction of the toner supply roller 18. As described above, the first roller 161 serves as the drive roller in the first embodiment. However, either one of the second roller 162 and the third roller 163 may serve as the drive roller.

The toner supply roller 18 may be composed of a metallic shaft 18*a* coated with an elastic layer 18*b*. The elastic layer 18*b* may be made of urethane resin, polyimide resin, polyimide-amide resin, urethane rubber, chloroprene rubber, silicone rubber or the like. The elastic layer 18*b* has a volume resistivity in the range of $10^7$ Ω·cm to $10^9$ Ω·cm, and has a surface roughness Rz in the range of 5 μm to 30 μm.

The developing blade 17 may be made of a sheet metal that has elasticity and a thickness in the range of 0.2 mm to 1.5 mm. The developing blade 17 has a bent portion at one end thereof and the bent portion is urged against the developing belt 164 at a predetermined pressure.

The developing belt 164 may be made of chloroprene rubber or the like, and has a volume resistivity in the range of $10^5$ Ω·cm to $10^8$ Ω·cm. In either case, where the volume resistivity is less than $10^5$ Ω·cm or greater than $10^8$ Ω·cm, production as desired of an electric potential gradient by resistive division, described later, becomes difficult. In addition, the developing belt 164 has a surface roughness Rz in the range of 2 μm to 15 μm.

The developing belt 164 may also be made of a semiconductive material such as urethane resin, polyimide resin, polyimide-amide resin, urethane rubber, silicone rubber or NBR (Nitrile Butadiene Rubber). In using these materials, the volume resistivity and the surface roughness Rz of the developing belt 164 should be respectively in the ranges of $10^5$ Ω·cm to $10^8$ Ω·cm and 2 μm to 15 μm.

The developing belt 164 is in contact with the toner supply roller 18 at a predetermined position between the first roller 161 and the third roller 163. The toner supply roller 18 is disposed so that the length of a contact portion (nip portion) formed between the developing belt 164 and the toner supply roller 18 in the rotational direction of the developing belt 164, i.e., a nip width L3, is in the range of 2 mm to 20 mm. If the nip width L3 is less than 2 mm, an adequate electric potential difference between a first contact point P1 and a second contact point P2, described later, is not produced. On the other hand, if the nip width L3 is greater than 20 mm, frictional resistance between the developing belt 164 and the toner supply roller 18 increases, thereby causing the toner 14 to markedly deteriorate.

The developing belt 164 is in contact with the photosensitive drum 11 at an opposed portion D between the first roller 161 and the second roller 162. The developing belt 164 rotates in the reverse direction of the rotational direction of the photosensitive drum 11, shown by the arrow "c" in FIG. 3, and at a circumferential speed in the range of 1.1 to 1.3 times that of the photosensitive drum 11.

While rotating, the developing belt 164 comes out of contact with the third roller 163 at a third contact point P3 and into contact with the first roller 161 at a fourth contact point P4. In addition, the developing belt 164 comes into contact with the toner supply roller 18 at the first contact point P1 and separates from the toner supply roller 18 at the second contact point P2. That is, the developing belt 164 is brought into contact with the toner supply roller 18 between the first contact point P1 and the second contact point P2. The first contact point P1 and the second contact point P2 are between the third contact point P3 and the fourth contact point P4, and respectively correspond to an upstream end point and a downstream end point of the contact portion in the rotational direction of the developing belt 164.

In the first embodiment, the first roller 161 is composed of a metallic shaft coated with a conductive elastic layer to improve the travelling performance of the developing belt 164. However, the metallic shaft itself may be sandblasted or knurled instead of being coated with the elastic layer.

In the first embodiment, the toner 14 may be a one-component toner, which may include a toner body and an additive agent that is added to a surface of the toner body. The toner body may be composed of a resin component such as polyester or polystyrene, a colorant, a release agent and a charge-controlling agent. The additive agent may be silica. The toner 14 may be made by a grinding method or a polymerization method. The toner 14 has a volume average particle size in the range of 3 μm to 10 μm, and has an average sphericity Φ in the range of 0.90 to 0.98.

The average sphericity Φ can be measured by a "flow particle image analyzer" (FPIA-2000: Sysmex Corp.). Specifically, the average sphericity Φ can be obtained by dividing the sum of sphericity of 3500 toner particles, which are detected by the "flow particle image analyzer," by the number of detected toner particles, i.e., "3500." The sphericity is an index that shows how close the shape of the toner 14 is to a sphere, and is calculated as follows:

Sphericity=(the diameter of a circle equivalent to a particle projected area)/(the diameter of a minimum circle circumscribed to a particle projected image).

The particle projected area is a binarized toner particle image area. In the case where the toner 14 is a true sphere, the sphericity is "1.00." The more complicated the shape of the toner 14 becomes, the smaller the sphericity becomes.

In addition, the amount of charge of the toner 14 is adjusted by adding the charge-controlling agent and the additive agent to the toner 14 so as to be in the range of −60 μQ/m to −20 μQ/m when the amount of charge is measured by a blow-off method.

A first high-voltage power supply 41 applies a first voltage VD1 to the first roller 161. A second high-voltage power supply 42 applies a second voltage VD2 to the second roller 162. A third high-voltage power supply 43 applies a third voltage VR to the third roller 163. A fourth high-voltage power supply 44 applies a fourth voltage VS to the toner supply roller 18. The first voltage VD1, the second voltage VD2, the third voltage VR and the fourth voltage VS have the same polarities, and their absolute values satisfy the following relationship:

$$|VD1|=|VD2|<|VS|<|VR|.$$

Next, an operation of the printer 1 will be described.

Upon starting a print operation, the drive motor, not shown, rotates the photosensitive drum 11, the first roller 161 and the toner supply roller 18. The toner 14 provided from the toner cartridge 13 adheres to a surface of the toner supply roller 18, and is carried toward the developing belt 164. The toner 14 contacts the developing belt 164 at the second contact point P2.

In the first embodiment, the first voltage VD1, the second voltage VD2, the third voltage VR and the fourth voltage VS are respectively set to −200 V, −200 V, −500 V and −350 V. A distance L1 between the third contact point P3 and the fourth contact point P4 is adjusted to 12 mm. A distance L2 between the second contact point P2 and the fourth contact point P4 is adjusted to 2 mm. The distance L3 between the first contact point P1 and the second contact point P2, which is the nip width, is adjusted to 8 mm. A distance L4 between the first contact point P1 and third contact point P3 is adjusted to 2 mm. Therefore, the distances L1, l2, L3 and L4 satisfy the following relationship:

$$L1=L2+L3+L4.$$

The developing belt 164 has a thickness of 1 mm. External diameters of the photosensitive drum 11, the first roller 161, the second roller 162, the third roller 163 and the toner supply roller 18 are respectively 30 mm, 6 mm, 6 mm, 6 mm and 15 mm.

Next, a relationship between the distance from the fourth contact point P4 in the reverse direction of the rotational direction of the developing belt 164 and the electric potential produced there on the developing belt 164 will be described with reference to FIG. 4.

Figure 4:
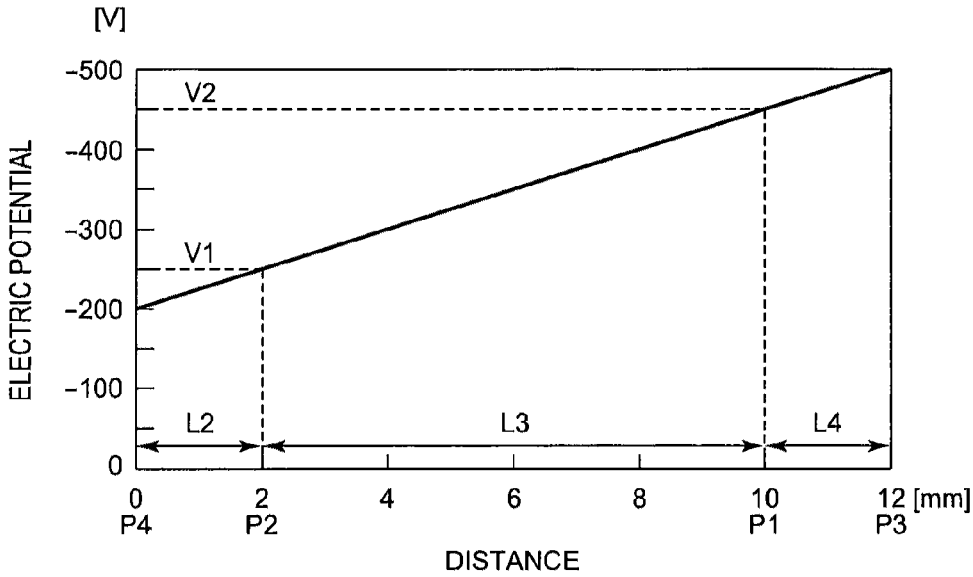
FIG. 4 is a graphic chart showing a relationship between the distance from a fourth contact point and the electric potential produced there on a developing belt.

FIG. 4 is a graphic chart showing the relationship between the distance from the fourth contact point P4 and the electric potential produced there on the developing belt 164, in which abscissa and ordinate axes respectively denote "distance" and "electric potential."

As described above, the first voltage VD1 and the third voltage VR are respectively applied to the first roller 161 and the third roller 163. Therefore, first electric potential V1 at the second contact point P2 is produced based on the distances L2, L3 and L4 and the electric potential difference VT between the first voltage VD1 and the third voltage VR. Specifically, the first electric potential V1 is produced by proportionally dividing the electric potential difference VT according to the relative portions of the total distance L1 made up by the respective component distances L2 and (L3+L4). Second electric potential V2 at the first contact point P1 is produced based on the electric potential difference VT and the distances L2, L3 and L4. Specifically, the second electric potential V2 is produced by proportionally dividing the electric potential difference VT according to the relative portions of the total distance L1 made up by the respective component distances (L2+L3) and L4.

Here, as described above, the first voltage VD1 and the third voltage VR are respectively set to −200 V and −500 V. Therefore, the electric potential difference VT is as follows:

$$VT=VR-VD1=-500-(-200)=-300\text{ V}.$$

As is also described above, the distances L1, L2, L3 and L4 are respectively adjusted to 12 mm, 2 mm, 8 mm and 2 mm. Therefore, the first electric potential V1, which is produced at the second contact point P2, is as follows:

$$V1=VD1+VT\times(L2/L1)=-200+(-300)\times(2/12)=-250\text{ V}.$$

The second electric potential V2, which is produced at the first contact point P1, is as follows:

$$V2=VR-VT\times(L4/L1)=-500-(-300)\times(2/12)=-450\text{ V}.$$

The first electric potential V1 at the second contact point P2 has the same polarity as the fourth voltage VS (−350 V), which is applied to the toner supply roller 18, and its absolute value is smaller than that of the fourth voltage VS, i.e., |V1|<|VS|. Therefore, an electric field by which the negatively charged toner 14 is transferred from the toner supply roller 18 to the developing belt 164, is formed at the second contact point P2. The toner 14 is transferred from the toner supply roller 18 to the developing belt 164 by the electric field, and adheres to the developing belt 164. The toner 14 on the developing belt 164 is carried toward the developing blade 17, where the toner 14 becomes a uniform thin layer when passing through the developing blade 17.

As described above, since the first voltage VD1 and the second voltage VD2 have the same polarities, the electric potential produced between a fifth contact point P5, where the developing belt 164 comes out of contact with the first roller 161, and a sixth contact point P6, where the developing belt 164 comes into contact with the second roller 162, is constant at −200 V irrespective of positions. Therefore, third electric potential V3, which is produced at the opposed portion D, is −200 V.

In this case, the value of the third electric potential V3 is suitable to develop the electrostatic latent image on the photosensitive drum 11 by reversal development. As described above, the electric potential of a surface portion of the photosensitive drum 11 where the electrostatic latent image is formed, is −50 V, and the electric potential of the other surface portion of the photosensitive drum 11 where the electrostatic latent image is absent, is −600 V, whereas the third electric potential V3 at the opposed portion D is −200 V. Therefore, the negatively charged toner 14 selectively adheres to the surface portion of the photosensitive drum 11 where the electrostatic latent image is formed, thereby developing the electrostatic latent image on the photosensitive drum 11. The residual toner (toner 14) on the developing belt 164, which does not contribute to developing the electrostatic latent image, is carried to the first contact point P1 with the rotation of the developing belt 164.

As described above, the second electric potential V2 at the first contact point P1 is −450 V. The second electric potential V2 has the same polarity as the fourth voltage VS (−350 V), which is applied to the toner supply roller 18, and its absolute value is greater than that of the fourth voltage VS, i.e., |V2|>|VS|. Therefore, an electric field by which the negatively charged residual toner (toner 14) is transferred from the developing belt 164 to the toner supply roller 18, is formed at the first contact point P1. This residual toner is transferred from the developing belt 164 to the toner supply roller 18 by the electric field, and is collected by the toner supply roller 18.

The residual toner collected by the toner supply roller 18 is carried toward the second contact point P2 together with the toner provided from the toner cartridge 13 with the rotation of the developing belt 164, and adheres to the developing belt 164 again.

In this manner, supply of the toner 14 on the toner supply roller 18 to the developing belt 164 at the second contact point P2 and collection of the toner 14 on the developing belt 164 by the toner supply roller 18 at the first contact point P1 are repeatedly performed.

As mentioned above, in the first embodiment, the developing belt 164 is entrained about the first roller 161, the second roller 162 and the third roller 163, and is in contact with the toner supply roller 18 between the first roller 161 and the third roller 163 so as to form the contact portion between them. Therefore, the developing unit 20 is capable of producing different electric potentials at both end points of the contact portion, or the first contact point P1 and the second contact point P2. That is to say, the developing unit 20 is capable of producing an electric potential for supplying the toner 14 on the toner supply roller 18 to the developing belt 164 at the second contact point P2, and a different electric potential for collecting the toner 14 on the developing belt 164 by the toner supply roller 18 at the first contact point P1, at the same time. Therefore, the residual toner on the developing belt 164 can be fully removed with the toner supply roller 18, thereby preventing the residual toner on the developing belt 164 from causing a residual image to be formed on the sheet. Thus, the developing unit 20 is capable of improving print quality.

In addition, the first electric potential V1 at the second contact point P2, the second electric potential V2 at the first contact point P1 and the third electric potential V3 at the opposed portion D can be adjusted to desired values, by respectively applying the second voltage VD2 and the third voltage VR, which are different from each other, to the second roller 162 and the third roller 163. This increases the design flexibility of the developing unit 20.

Moreover, contact portions that have predetermined widths are formed between the developing belt 164 and the photosensitive drum 11, and also between the developing belt 164 and the toner supply roller 18, by using the developing belt 164. Therefore, contact pressures between the developing belt 164 and the photosensitive drum 11, and between the developing belt 164 and the toner supply roller 18 can be reduced, thereby preventing deterioration of the photosensitive drum 11, the toner supply roller 18, the developing belt 164, the toner 14 and the like.

Furthermore, since the first voltage VD1 and the second voltage VD2 have the same polarities and values, the electric potential produced between the fifth contact point P5 and the sixth contact point P6 is constant irrespective of positions. That is to say, the third electric potential V3 at the opposed portion D is constant irrespective of its position between the fifth contact point P5 and the sixth contact point P6. Therefore, the developing belt 164 can be brought into contact with the photosensitive drum 11 at any portion between the fifth contact point P5 and the sixth contact point P6, thereby increasing the layout flexibility of the developing belt 164 relative to the photosensitive drum 11. This further increases the design flexibility of the developing unit 20.

Second Embodiment

Elements of a printer and a developing unit of the second embodiment are respectively the same as those of the printer 1 and the developing unit 20 of the first embodiment. Therefore, the second embodiment will be described with reference to FIGS. 1 to 3.

In the second embodiment, the first voltage VD1, the second voltage VD2, the third voltage VR and the fourth voltage VS are respectively set to +50 V, −450 V, −250 V and −100 V. That is to say, the first voltage VD1 has a polarity that is opposite to the polarities of the second voltage VD2, the third voltage VR and the fourth voltage VS, and absolute values of the second voltage VD2, the third voltage VR and the fourth voltage VS satisfy the following relationship:

$$|VS|<|VR|<|VD2|.$$

Similarly to the first embodiment, the distances L1, L2, L3 and L4 are respectively adjusted to 12 mm, 2 mm, 8 mm and 2 mm, and satisfy the following relationship:

$$L1=L2+L3+L4.$$

As described above, the first voltage VD1 and the third voltage VR are respectively applied to the first roller 161 and the third roller 163. Therefore, the first electric potential V1 at the second contact point P2 is produced based on the distances L2, L3 and L4 and the electric potential difference VT between the first voltage VD1 and the third voltage VR. Specifically, the first electric potential V1 is produced by proportionally dividing the electric potential difference VT according to the relative portions of the total distance L1 made up by the respective component distances L2 and (L3+L4). The second electric potential V2 at the first contact point P1 is produced based on the electric potential difference VT and the distances L2, L3 and L4. Specifically, the second electric potential V2 is produced by proportionally dividing the electric potential difference VT according to the relative portions of the total distance L1 made up by the respective component distances (L2+L3) and L4.

Here, as described above, the first voltage VD1 and the third voltage VR are respectively set to +50 V and −250 V. Therefore, the electric potential difference VT is as follows:

$$VT=VR-VD1=-250-(+50)=-300\text{ V}.$$

As is also described above, the distances L1, L2, L3 and L4 are respectively adjusted to 12 mm, 2 mm, 8 mm and 2 mm. Therefore, the first electric potential V1, which is produced at the second contact point P2, is as follows:

$$V1=VD1+VT\times(L2/L1)=50+(-300)\times(2/12)=0\text{ V}.$$

The second electric potential V2, which is produced at the first contact point 21, is as follows:

$$V2=VR-VT\times(L4/L1)=-250-(-300)\times(2/12)=-200\text{ V}.$$

The first electric potential V1 at the second contact point P2 has the same polarity as the fourth voltage VS (−100 V), which is applied to the toner supply roller 18, and its absolute value is smaller than that of the fourth voltage VS, i.e., |V1|<|VS|. Therefore, an electric field by which the negatively charged toner 14 is transferred from the toner supply roller 18 to the developing belt 164, is formed at the second contact point P2. The toner 14 is transferred from the toner supply roller 18 to the developing belt 164 by the electric field, and adheres to the developing belt 164. The toner 14 on the developing belt 164 is carried toward the developing blade 17, where the toner 14 becomes a uniform thin layer when passing through the developing blade 17.

When the opposed portion D, where the developing belt 164 is opposed to the photosensitive drum 11, is located in the middle of the first roller 161 and the second roller 162, the third electric potential V3 at the opposed portion D is as follows:

$$V3=VD2-(VD2-VD1)\times(1/2)=-450-(-450-50)\times(1/2)=-200\text{ V}.$$

In this case, the value of the third electric potential V3 is suitable to develop the electrostatic latent image on the photosensitive drum 11 by reversal development. As described above, the electric potential of a surface portion of the photosensitive drum 11 where the electrostatic latent image is formed, is −50 V, and the electric potential of the other surface portion of the photosensitive drum 11 where the electrostatic latent image is absent, is −600 V, whereas the third electric potential V3 at the opposed portion D is −200 V. Therefore, the negatively charged toner 14 selectively adheres to the surface portion of the photosensitive drum 11 where the electrostatic latent image is formed, thereby developing the electrostatic latent image on the photosensitive drum 11. The residual toner (toner 14) on the developing belt 164, which does not contribute to developing the electrostatic latent image, is carried to the first contact point P1 with the rotation of the developing belt 164.

As described above, the second electric potential V2 at the first contact point P1 is −200 V. The second electric potential V2 has the same polarity as the fourth voltage VS (−100 V), which is applied to the toner supply roller 18, and its absolute value is greater than that of the fourth voltage VS, i.e., |V2|>|VS|. Therefore, an electric field by which the negatively charged residual toner (toner 14) is transferred from the developing belt 164 to the toner supply roller 18, is formed at the first contact point P1. This residual toner is transferred from the developing belt 164 to the toner supply roller 18 by the electric field, and is collected by the toner supply roller 18.

The residual toner collected by the toner supply roller 18 is carried toward the second contact point P2 together with the toner provided from the toner cartridge 13 with the rotation of the developing belt 164, and adheres to the developing belt 164 again.

In this manner, supply of the toner 14 on the toner supply roller 18 to the developing belt 164 at the second contact point P2 and collection of the toner 14 on the developing belt 164 by the toner supply roller 18 at the first contact point P1 are repeatedly performed.

As mentioned above, in the second embodiment, even though the values of the first voltage VD1, which is applied to the first roller 161, and the second voltage VD2, which is applied to the second roller 162, are different from each other, the developing unit 20 of the second embodiment has similar advantages to that of the first embodiment.

Modification

The first roller 161 may be connected to ground, or the first voltage VD1 may be set to 0 V. In this case, the second voltage VD2, the third voltage VR and the fourth voltage VS are respectively set to −400 V, −300 V and −150 V, which produce a first electric potential V1 of −50 V at the second contact point P2. The first electric potential V1 at the second contact point P2 has the same polarity as the fourth voltage VS (−150 V), which is applied to the toner supply roller 18, and its absolute value is smaller than that of the fourth voltage VS, i.e., |V1|<|VS|. Therefore, an electric field by which the negatively charged toner 14 is transferred from the toner supply roller 18 to the developing belt 164, is formed at the second contact point P2.

When the opposed portion D, where the developing belt 164 is opposed to the photosensitive drum 11, is located in the middle of the first roller 161 and the second roller 162, the third electric potential V3 at the opposed portion D becomes −200 V. In this case, the value of the third electric potential V3 is suitable to develop the electrostatic latent image on the photosensitive drum 11 by reversal development. Therefore, the toner 14 on the developing belt 164 adheres to the photosensitive drum 11 at the opposed portion D.

The second electric potential V2 at the first contact point P1 becomes −350 V. The second electric potential V2 has the same polarity as the fourth voltage VS (−150 V), which is applied to the toner supply roller 18, and its absolute value is greater than that of the fourth voltage VS, i.e., |V2|>|VS|. Therefore, an electric field by which the negatively charged residual toner (toner 14) is transferred from the developing belt 164 to the toner supply roller 18, is formed at the first contact point P1. This residual toner is transferred from the developing belt 164 to the toner supply roller 18 by the electric field, and is collected by the toner supply roller 18.

While each embodiment has been described with respect to a color printer, the invention may be applicable to any other image forming apparatus, such as a monochrome printer, a copier, a facsimile machine or a multifunction peripheral (MFP).

The developing device and the image forming apparatus being thus described, it will be apparent that the same may be varied in many ways. Such variations are not to be regarded as a departure from the sprit and scope of the invention, and all such modifications as would be apparent to one of ordinary skill in the art are intended to be included within the scope of the following claims.

What is claimed is:

1. A developing device that develops an electrostatic latent image on an image bearing body, comprising:

a first roller;

a second roller;

a third roller;

a developing belt entrained about the first, second and third rollers; and a developer supply member that supplies a developer to the developing belt, the developing belt being opposed to the image bearing body between the first and second rollers, and being in contact with the developer supply member between the first and third rollers.

2. The developing device according to claim 1, wherein a contact portion between the developing belt and the developer supply member has a predetermined width in a rotational direction of the developing belt.

3. The developing device according to claim 2, wherein the developer supply member supplies the developer to the developing belt at a downstream end point of the contact portion in said rotational direction, and collects the developer on the developing belt at an upstream end point of the contact portion in said rotational direction.

4. The developing device according to claim 3, further comprising:

a first power supply that applies a first voltage to the first roller;

a second power supply that applies a second voltage to the second roller;

a third power supply that applies a third voltage to the third roller; and a fourth power supply that applies a fourth voltage to the developer supply member.

5. The developing device according to claim 4, wherein a first electric potential produced at the downstream end point has the same polarity as the fourth voltage and its absolute value is smaller than that of the fourth voltage, and a second electric potential produced at the upstream end point has the same polarity as the fourth voltage and its absolute value is greater than that of the fourth voltage.

6. The developing device according to claim 1, further comprising:

a first power supply that applies a first voltage to the first roller;

a second power supply that applies a second voltage to the second roller;

a third power supply that applies a third voltage to the third roller; and a fourth power supply that applies a fourth voltage to the developer supply member.

7. The developing device according to claim 6, wherein the first voltage and the second voltage have the same polarities and values.

8. The developing device according to claim 6, wherein the first voltage, the third voltage and the fourth voltage have the same polarities, and designating the first voltage, the third voltage and the fourth voltage as respectively VD1, VR and VS, they satisfy the following relationship:

$$|VD1|<|VS|<|VR|.$$

9. The developing device according to claim 6, wherein the first voltage has a polarity that is opposite to polarities of the third voltage and the fourth voltage, and designating the third voltage and the fourth voltage as respectively VR and VS, they satisfy the following relationship:

$$|VS|<|VR|.$$

10. The developing device according to claim 6, wherein the first voltage is 0 V and the third voltage and the fourth voltage have the same polarities, and designating the third voltage and the fourth voltage as respectively VR and VS, they satisfy the following relationship:

$$|VS|<|VR|.$$

11. The developing device according to claim 6, wherein the first voltage and the second voltage are different from each other.

12. The developing device according to claim 1, wherein the developing belt supplies the developer to the image bearing body at an opposed portion between the developing belt and the image bearing body, and the developer supply member supplies the developer to the developing belt and collects the developer on the developing belt at a contact portion between the developing belt and the developer supply member.

13. The developing device according to claim 1, wherein the developing belt supplies the developer to the electrostatic latent image formed on the image bearing body.

14. The developing device according to claim 1, wherein the developing belt has a volume resistivity in the range of $10^5$ Ω·cm to $10^8$ Ω·cm.

15. The developing device according to claim 1, wherein the developing belt has a surface roughness Rz in the range of 2 μm to 15 μm.

16. The developing device according to claim 1, wherein the developer supply member includes a shaft coated with an elastic layer.

17. The developing device according to claim 16, wherein the elastic layer has a volume resistivity in the range of $10^7$ Ω·cm to $10^9$ Ω·cm.

18. The developing device according to claim 16, wherein the elastic layer has a surface roughness Rz in the range of 5 μm to 30 μm.

19. An image forming apparatus comprising:

a medium storage unit that accommodates a medium;

a developing unit that develops an electrostatic latent image on an image bearing body to form a developed image and includes a first roller, a second roller, a third roller, a developing belt entrained about the first, second and third rollers, and a developer supply member that supplies a developer to the developing belt, the developing belt being opposed to the image bearing body between the first and second rollers, and being in contact with the developer supply member between the first and third rollers;

a transfer unit that transfers the developed image to the medium; and a fixing unit that fixes the developed image on the medium.

* * * * *